US006995128B2

(12) United States Patent
Mitra et al.

(10) Patent No.: US 6,995,128 B2
(45) Date of Patent: Feb. 7, 2006

(54) MIXED SURFACTANT CLEANING COMPOSITIONS WITH REDUCED STREAKING

(75) Inventors: Shumanta Mitra, Dulbin, CA (US); Scott T. Haubrich, Castro Valley, CA (US); Boli Zhou, Tigard, OR (US)

(73) Assignee: The Clorox Co., Oakland, CA (US)

( * ) Notice: Subject to any disclaimer, the term of this patent is extended or adjusted under 35 U.S.C. 154(b) by 0 days.

(21) Appl. No.: 09/990,028

(22) Filed: Nov. 21, 2001

(65) Prior Publication Data

US 2002/0151448 A1 Oct. 17, 2002

Related U.S. Application Data

(63) Continuation-in-part of application No. 09/689,433, filed on Oct. 11, 2000, now Pat. No. 6,540,424.

(60) Provisional application No. 60/317,319, filed on Sep. 4, 2001, provisional application No. 60/253,010, filed on Nov. 24, 2000, provisional application No. 60/192,040, filed on Mar. 24, 2000.

(51) Int. Cl.
*C11D 3/43* (2006.01)

(52) U.S. Cl. ..... 510/365; 510/180; 510/417; 510/424; 510/432; 510/506

(58) Field of Classification Search ..... 510/365, 510/220, 221, 376, 505, 506, 432, 218
See application file for complete search history.

(56) References Cited

U.S. PATENT DOCUMENTS

| | | | | |
|---|---|---|---|---|
| 4,606,842 | A | 8/1986 | Keyes et al. | 252/174.23 |
| 5,510,047 | A * | 4/1996 | Gabriel et al. | 510/221 |
| 5,534,184 | A * | 7/1996 | Underwood | 510/426 |
| 6,017,872 | A * | 1/2000 | Pedersen et al. | 510/424 |
| 6,204,230 | B1 * | 3/2001 | Taylor et al. | 510/131 |
| 6,274,645 | B1 * | 8/2001 | Gundlach et al. | 523/160 |
| 6,399,553 | B1 * | 6/2002 | Cable et al. | 510/182 |
| 6,451,748 | B1 * | 9/2002 | Taylor et al. | 510/131 |

* cited by examiner

*Primary Examiner*—Gregroy Webb
(74) *Attorney, Agent, or Firm*—Monica H. Winghart; Joel J. Hayashida

(57) ABSTRACT

The invention provides an improved, reduced streaking/filming dilute cleaning formulation which is to be used in a no-rinse cleaning application, preferably either by a dosing dispenser or in a combined cleaning tool which contains a cleaning head, a handle, a reservoir of the cleaning formulation mounted to said handle and a means for dispensing the cleaning formulation in a suitable direction relative to the cleaning head.

10 Claims, No Drawings

MIXED SURFACTANT CLEANING COMPOSITIONS WITH REDUCED STREAKING

RELATED APPLICATIONS

This application claiming priority to provisional application No. 60/253,010, filed Nov. 24, 2000, and is related to application Ser. No. 09/689,433, filed Oct. 11, 2000 now U.S. Pat. No. 6,540,424 (itself claiming priority to provisional application No. 60/192,040, filed Mar. 24, 2000), and claims benefit of Applicaton Ser. No. 10/166,333 now abandonded entitled ADVANCED CLEANING SYSTEM, and is further related to pending provisional application No. 60/317,319, filed Sep. 4, 2001, entitled FLOW THROUGH A LOW PRESSURE GRAVITY FED CLEANING TOOL, itself a continuation-in-part of said Ser. No. 09/689,433, all of which are incorporated herein by reference thereto.

BACKGROUND OF THE INVENTION

1. Field of the Invention

The invention relates to an improved, reduced streaking/filming dilute cleaning formulation which is to be used in a no-rinse cleaning application, preferably either by a dosing dispenser or in a combined cleaning tool which contains a cleaning head, a handle, a reservoir of the cleaning formulation mounted to said handle and a means for dispensing the cleaning formulation in a suitable direction relative to the cleaning head. The improved cleaning formulation surprisingly enhances the hard surfaces to which it is applied by rendering the surfaces free of dirt, yet imparting transparent shine thereto.

2. Brief Statement of the Related Art

In the quest for appropriate cleaning formulations which are effective at cleaning, yet modify appropriately the surfaces to which they are applied, many different approaches have been applied. Standard window cleaning formulations may contain essentially nothing more than water, ammonia, a minute amount of surfactant and a coloring agent (typically, a blue dye). These types of cleaners are not really effective and their advantage appears to be limited to leaving little residue behind. Other no-rinse cleaners are much more effective, such as, for example, those which utilize a low residue surfactant, such as cocoamidopropylamine oxide, or an other such surfactant, along with an effective chelant, such as monoethanolamine or ammonium carbamate. These types of cleaners are exemplified by: Garabedian et al., U.S. Pat. Nos. 5,252,245, 5,437,807, 5,468,423 and 5,523,024, and Choy et al., U.S. Pat. No. 5,585,342, all of common assignment herewith and whose disclosures are incorporated herein by reference. Other commonly assigned and copending applications include U.S. application Ser. Nos. 08/869,854 and 08/879,093, both for Reduced Residue Hard Surface Cleaners (whose disclosures are incorporated herein by reference thereto), which disclose combinations of diphenyl oxide disulfonate surfactants, but without polymers, which are useful in glass cleaning applications. Glass cleaning, unlike floor cleaning, benefits from an up close and personal use of wicking materials, such as paper towels, and doctoring instruments, such as squeegees, or both, which provide for fairly thorough removal of the cleaning product and the soil targeted therewith, since cleaning of glass is usually done in the line of vision.

Another reference, Keyes et al., U.S. Pat. No. 4,606,842, discloses cleaning compositions containing quite low molecular weight (less than 8,000 Daltons). It is questionable whether such low molecular weight polymers would be effective in the cleaning formulations of the invention.

However, there remains a need for yet further no-rinse cleaners, especially those which will be used on floors or other larger surfaces, where effective cleaning and imparting a transparent shine after applying a cleaner is important.

SUMMARY AND OBJECTS OF THE INVENTION

The invention provides the use of a dilute, mixed surfactant system.

It is therefore an object of this invention to provide improved, reduced streaking/filming dilute cleaning formulation which is to be used in a no-rinse cleaning application, preferably either by a dosing dispenser or in a combined cleaning tool which contains a cleaning head, a handle, a reservoir of the cleaning formulation mounted to said handle and a means for dispensing the cleaning formulation in a suitable direction relative to the cleaning head.

It is a further object of this invention to enhance the hard surfaces to which it is applied by rendering the surfaces free of dirt, yet imparting transparent shine thereto.

DETAILED DESCRIPTION OF THE INVENTION

The invention provides an improved, reduced streaking/filming dilute cleaning formulation which is to be used in a no-rinse cleaning application, preferably either by a dosing dispenser or in a combined cleaning tool which contains a cleaning head, a handle, a reservoir of the cleaning formulation mounted to said handle and a means for dispensing the cleaning formulation in a suitable direction relative to the cleaning head.

In the application, effective amounts are generally those amounts listed as the ranges or levels of ingredients in the descriptions which follow here to. Unless otherwise stated, amounts listed in percentage ("%'s") are in weight percent of the composition, unless otherwise noted.

1. The Mixed Surfactants:

A mixture of a nonionic and an anionic surfactant are used herein. The nonionic surfactant is generally an ethoxylated alcohol with an HLB of at least about 8, while the anionic is most preferably a diphenyloxide disulfonate.

The nonionic surfactants used herein comprise surfactants which have a HLB of at least about 8. For a further discussion of HLB measurements, one should consult Popiel, *Introduction to Colloid Science* (1978), pp. 43–44 and Gerhartz, *Ullmann's Encyclopedia of Industrial Chemistry,* 5th Ed., Vol. A9 (1985), pp. 322–23, both of which are incorporated by reference thereto. Most preferably, the nonionic surfactant is Alfonic 1012-5, which is a $C_{10-12}$ alcohol ethoxylated with 5 moles of ethylene oxide per mole of alcohol, available from Condea Chemie (Applicants note that chemical manufacturers are commonly selling off lines of ingredients, are subject to acquisition, or otherwise may differ during the course of prosecution of this application. Applicants thus take leave to update or modify the ownership of the ingredients discussed herein.) The anionic surfactant of greatest preference is Dowfax 2A1, which is a diphenyl oxide disulfonate available from Dow Chemical. The alkyl diphenyl oxide disulfonates are atypical surfactants and preferably include an alkyl chain group of $C_{6-20}$. Another surfactant is Dowfax 3B2, an n-decyl diphenyloxide disulfonate. Pilot Chemical is another source of the alkyl diphenyl oxide disulfonate surfactant. Other types of anionic surfactants have not been found to be as effective and are thus not as preferred.

Other surfactants which could supplement, or possibly substitute, for the foregoing nonionic surfactant may be selected from linear and branched alkoxylated alcohols and alkoxylated alkylphenols. The alkoxylated alcohols include ethoxylated, propoxylated, and ethoxylated and propoxylated $C_{5-20}$ alcohols, with about 1–5 moles of ethylene oxide, or about 1–5 moles of propylene oxide, or 1–5 and 1–5 moles of ethylene oxide and propylene oxide, respectively, per mole of alcohol. There are a wide variety of products from numerous manufacturers, such as the Neodol series from Texaco Chemical Co., to wit, Neodol 25-3, a linear $C_{12-15}$ alcohol ethoxylate with 3 moles of ethylene oxide ("EO") per mole of alcohol, HLB of 7.8, and Neodol 91-2.5,a linear $C_{9-11}$ alcohol ethoxylate with 2.5 moles of EO; Alfonic 1412-40, a $C_{12-14}$ ethoxylated alcohol with 3 moles of EO from Conoco; Surfonic L12-2.6, a $C_{10-12}$ ethoxylated alcohol with 3 moles of EO, and Surfonic L24-3, a $C_{12-14}$ ethoxylated alcohol with 3 moles of EO from Huntsman Chemical; and Tergitol 25-L-3, a $C_{12-15}$ ethoxylated alcohol with 3 moles of EO, from Union Carbide. The secondary ethoxylated alcohols include Tergitol 15-S-3, a $C_{11-15}$ secondary ethoxylated alcohol, with 3 moles of EO, from Union Carbide. The branched surfactants, especially preferred of which are tridecyl ethers, include Trycol TDA-3, a tridecyl ether with 3 moles of EO, from Henkel KGaA (formerly, Emery), and Macol TD 3, a tridecyl ether with 3 moles of EO, from PPG Industries. See, also, *McCutcheon's Emulsifiers and Detergents,* 1987. The sparingly soluble nonionic surfactant can also be selected from alkoxylated alkylphenols, such as: Macol NP-4, an ethoxylated nonylphenol with 4 moles of EO, and an HLB of 8.8, from PPG; Triton N-57, an ethoxylated nonylphenol with an HLB of 10.0, Triton N-42, an ethoxylated nonylphenol with an HLB of 9.1, both from Rohm & Haas Co.; and Igepal CO-520, with an HLB of 10.0, an ethoxylated nonylphenol from GAF Chemicals Corp.; Alkasurf NP-5, with an HLB of 10.0, and Alkasurf NP-4, with an HLB of 9.0, both of which are ethoxylated nonylphenols from Alkaril Chemicals; Surfonic N-40, with an HLB of 8.9, an ethoxylated nonylphenol from Huntsman. See, *McCutcheon's Emulsifiers and Detergents* (1987), especially page 282, incorporated herein by reference thereto. The nonionic surfactant can be chosen from, among others: Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{14-15}$ ethoxylated alcohol with 7 moles of EO, Neodol 23-5, a linear $C_{12-13}$ alcohol ethoxylate with 5 moles of EO, HLB of 10.7; Surfonic surfactants, also sold by Huntsman Chemical Company, such as Surfonic L12-6, a $C_{10-12}$ ethoxylated alcohol with 6 moles of EO and L24-7, a $C_{12-14}$ ethoxylated alcohol with 7 moles of EO; and Tergitol surfactants, both sold by Union Carbide, such as Tergitol 25-L-7, a $C_{12-15}$ ethoxylated alcohol with 7 moles of EO. Macol NP-6, an ethoxylated nonylphenol with 6 moles of EO, and an HLB of 10.8, Macol NP-9.5, an ethoxylated nonylphenol with about 11 moles EO and an HLB of 14.2, Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, and Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman.

The amount of the nonionic surfactants is generally between about 0.01 to about 1.0%, of the aqueous composition. On the other hand, the ratio between the nonionic and anionic surfactants, should be from about 0.1:1 to about 1:1, more preferably between about 0.5:1 to 0.9:1.

2. The Water Soluble Polymer

Shining, restorative or anti-filming agents are generally polymers, especially those that will lay down a coating or residue to a surface treated therewith such as to confer shine, dimensional stabilization or finish, or prevent re-soiling or other such surface protection/modification. Examples of such materials include a water soluble to dispersible polymer having a molecular weight of generally below 2,000,000 daltons. The polymers will also be not damaging to fabrics, carpets, and other soft surfaces. They should have enough tack or stickiness, when applied and dried, to provide a matrix in which the malodor may be entrapped, but not so much that to the human touch the film or residue feels or imparts an obvious sticky feel. Preferably, the polymer will also not itself have an obvious or offensive odor, although that attribute can be mitigated by judicious selection of fragrance.

The preferred polymer is a polyacrylate polymer. These include, for example:

a. Acrylate Polymers

Polyacrylate, co-polymers with acrylate co-monomers, and the like are most preferred polymers for use herein. The polyacrylate polymers are characterized in being most preferably above 10,000, more preferably above 20,000, and most preferably, above 30,000 Daltons in molecular weight. Other suitable polymers are acrylic emulsion polymers used as floor polish coatings. These are generally copolymers of one or more acidic monomers, such as acrylic acid, methacrylic acid or maleic anhydride, with at least one other ethylenically unsaturated monomer selected from a group consisting of ethylene and other simple olefins, styrene, alpha-methylstyrene, methyl, ethyl and $C_3$ to $C_8$ alkyl acrylates and methacrylates, isobomyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, and the like. It is also frequently desirable to include minor amounts of other functional monomers, such as acetoacetoxy methacrylate or other acetoacetate monomers and divinyl or polyvinyl monomers, such as glycol polyacrylates, allyl methacrylate, divinyl benzene and the like. The preferred polymers have an acid number from about 75 to about 500 and a number average molecular weight of about 10,000 to about 50,000, most preferably about 25,000 to 40,000. These polymers may also be crosslinked with metal ions or modified for crosslinking with silane functionality as described, for example, in U.S. Pat. No. 5,428,107. Examples of such acrylic emulsion polymers include those available under the Rhoplex trade name from Rohm & Haas, such as Rhoplex 1531, Rhoplex AC-33, Rhoplex B-924, and Rhoplex MC-76. There are also polymers from National Starch and Chemical, such as Amaze, Flexan and Balance CR, Balance 47 and Balance 055. Other preferred polymers are Carboset GA 233, EX561 and 2123, all by B. F. Goodrich. Other suitable polymers are copolymers of acrylic and/or methacrylic acid with acrylate and methacrylate esters. For example, a copolymer of 51% methyl methacrylate, 31% butyl acrylate, and 18% acrylic acid is available from Rohm & Haas as Emulsion Polymer E-1250. Additionally, there are acrylates from Rohm and Haas, namely, Acusol, such as Acusol 445, and the like. Most preferred is Rhoplex 1531, which has a molecular weight of about 30,000 Daltons and an acid number of from about 46–49.

Other suitable polymers may include cationic acrylic water soluble polymers that are copolymers of cationic quaternized acrylates, methacrylates, acrylamides, and methacrylamides, for example trimethylammoniumpropylmethacrylate, and acrylamide or acrylonitrile.

Examples of other, potentially suitable classes of polymers include:

b. Fluoropolymers

Fluoropolymers which are potentially useful in the invention are those which have a molecular weight of at least about 5,000 Daltons, more preferably at least about 10,000 Daltons. In fact, some of the polymers considered useful herein may have molecular weights upwards of 300,000 Daltons. The fluoropolymers can be at least partially substituted with water solubilizing groups, such as, without limitation, carboxyl, amido, sulfonato, ethoxyl, propoxyl and the like. It is thus preferred that the fluoropolymers be at least water-dispersible, and preferably, are at least sparingly water-soluble. These types of fluoropolymers include fluorinated substituted urethanes (such as Zonyl® 7910 from E.I. du Pont de Nemours and Co., hereinafter, "DuPont"), and perfluoroalkylmethacrylic copolymers (such as such as Zonyl® 8740 from DuPont, and Zonyl 9027, also from DuPont.

c. Polysaccharides

Suitable polymers may comprise polysaccharide polymers, which include substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum or derivatives thereof. Particularly useful polysaccharides are xanthan gum and derivatives thereof. Some of these are thickeners which may have too much tack, from a performance and aesthetic standpoint. Additional suitable polysaccharide polymers may include sodium caseinate and gelatin. Other suitable polysaccharide polymers may include cationic derivatives, such as the cationic cellulose ether, Polymer JR.

d. Polycarboxylates

Polycarboxylates may also be useful. These polymers contain amounts of nonionizable monomers, such as ethylene and other simple olefins, styrene, alpha-methylstyrene, methyl, ethyl and $C_3$ to $C_8$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates. Other suitable polymers include other polycarboxylates, such as homopolymers and copolymers of monomeric units selected from the group consisting of unsaturated carboxylic acids such as acrylic acid, methacrylic acid, polycarboxylic acids, sulfonic acids, phosphonic acids and mixtures thereof. Copolymerization of the above monomeric units among them or with other comonomers such as maleic anhydride, ethylene or propylene are also suitable.

e. Polystyrenesulfonates

Other suitable polymers may include polystyrenesulfonates such as Flexan 130 and Versa TL501 from National Starch and Chemical. Polystyrenesulfonates are also useful as copolymers, for example Versa TL-4 also from National Starch and Chemical.

f. Polyethyleneimines

Other suitable polymers may be polyethyleneimines and copolymers with other polyalkyleneimines. These amino-functional polymers can also be modified by ethoxylation and propoxylation. These amino-functional polymers can also be quantemized with methyl groups or oxidized to amine oxides.

g. Polyvinylpyrrolidones

Other suitable polymers may include vinylpyrrolidone homopolymers and copolymers. Suitable vinylpyrrolidone homopolymers have an average molecular weight of from 1,000 to 100,000,000, preferably from 2,000 to 10,000,000, more preferably from 5,000 to 1,000,000, and most preferably from 30,000 to 700,000. Suitable vinyl pyrrolidone homopolymers are commercially available from ISP Corporation, Wayne, New Jersey under the product names PVP K-15 (average molecular weight of 8,000), PVP K30 (average molecular weight of 38,000), PVP K-60 (average molecular weight of 216,000), PVP K-90 (average molecular weight of 630,000), and PVP K-120 (average molecular weight of 2,900,000). Suitable copolymers of vinylpyrrolidone include copolymers of N-vinylpyrrolidone with one or more alkylenically unsaturated monomers. Suitable alkylenically unsaturated monomers include unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. Any of the esters and amides of the unsaturated acids may be employed, for example, methyl acrylate, ethylacrylate, acrylamide, methacryamide, dimethylaminoethylmethacrylate, dimethylamino-propylmethacrylamide, trimethylammoniumethylmethacrylate, and trimethyl-ammoniumpropylmethacrylamide. Other suitable alkylenically unsaturated monomers include aromatic monomers such as styrene, sulphonated styrene, alpha-methylstyrene, vinyltoluene, t-butylstyrene and others. Copolymers of vinylpyrrolidone with vinyl acetate are commercially available under the trade name PVP/VA from ISP Corporation. Copolymers of vinylpyrrolidone with alpha-olefins are available, for example, as P-904 from ISP Corporation. Copolymers of vinylpyrrolidone with dimethylaminoethylmethacrylate are available, for example, as Copolymer 958 from ISP Corporation. Copolymers of vinylpyrrolidone with trimethylammoniumethylmethacrylate are available, for example, as Gafquat 734 from ISP Corporation. Copolymers of vinylpyrrolidone with trimethyl-ammonium-propylmethacrylamide are available, for example, as Gafquat HS-100 from ISP Corporation. Copolymers of vinylpyrrolidone with styrene are available, for example, as Polectron 430 from ISP Corporation. Copolymers of vinylpyrrolidone with acrylic acid are available, for example, as Polymer ACP 1005 (25% vinylpyrrolidone/75% acrylic acid) from ISP Corporation.

h. Methylvinyl ether

Other suitable polymers may include methylvinylether homopolymers and copolymers. Preferred copolymers are those with maleic anhydride. These copolymers can be hydrolyzed to the diacid or derivatized as the monoalkyl ester. For example, the n-butyl ester is available as Gantrez ES-425 from ISP Corporation.

i. Polyvinyl alcohols

Other suitable polymers may include polyvinyl alcohols. Preferably, polyvinyl alcohols which are at least 80.0%, preferably 88–99.9%, and most preferably 99.0–99.8% hydrolyzed are used. For example, the polyvinyl alcohol, Elvanol 71-30 is available from E. I. DuPont de Nemours and Company, Wilmington, Del.

j. Polyethylene Glycols

Yet other feasible polymers may be polyethylene glycols, such as disclosed in Baker et al., U.S. Pat. No. 4,690,779, incorporated herein by reference.

Mixtures of any of the foregoing polymers may be possible or desirable.

3. Water

The third principal ingredient is water, which should be present at a level of at least about 50%, more preferably at least about 60%, and most preferably, at least about 70%. Deionized water is most preferred. Water forms the predominant, continuous phase in which the oil phase is dispersed.

4. Organic Solvents

The solvents useful in this invention are organic solvents with a vapor pressure of at least 0.001 mm Hg at 25° C. and soluble to the extent of at least 1 g/100 ml water. The upper limit of vapor pressure appears to be about 100 mm Hg at 25° C. Vapor pressure is a useful measure for determining the applicability of the given solvent, since one would select a solvent which will volatilize sufficiently so as to leave no visible residue. The organic solvent of the invention is preferably selected from $C_{1-6}$ alkanol, $C_{3-24}$ alkylene glycol ether, and mixtures thereof. However, other, less water soluble or dispersible organic solvents may be possible. It is preferred that a mixture of the $C_{1-6}$ alkanol and $C_{3-24}$ alkylene glycol ether solvents be used. The alkanol can be selected from methanol, ethanol, n-propanol, isopropanol, butanol, pentanol, hexanol, their various positional isomers, and mixtures of the foregoing. In the invention, it has been found most preferable to use isopropanol, usually in conjunction with a glycol ether, such as propylene glycol n-propyl ether. It may also be possible to utilize in addition to, or in place of, said alkanols, the diols such as methylene, ethylene, propylene and butylene glycols, and mixtures thereof. Other solvents, such as ketones, ethers, hydrocarbons and halides may be used. Other examples of solvents can be found in *Kirk-Othlner, Encyclopedia of Chemical Technology* 3rd, Vol. 21, pp. 377–401 (1983), incorporated by reference herein.

The alkylene glycol ether solvents can include ethylene glycol monobutyl ether, ethylene glycol monopropyl ether, propylene glycol monopropyl ether, propylene glycol monobutyl ether, and mixtures thereof. One preferred particularly preferred glycol ether is propylene glycol, monopropyl ether, sold as Dowanol PNP from Dow Chemical. The use of this particular glycol ether with IPA results in a transparent formulation, the combination of solvents nicely dispersing the other ingredients into solution. It is preferred to limit the total amount of solvent to no more than 50%, more preferably no more than 25%, and most preferably, no more than 5%, of the cleaner. However, in some of the compositions of this invention, no solvent may be present. A preferred range is about 1–5%, and if a mixed solvent system of alkanol/glycol ether is used, the ratio of alkanol to alkylene glycol ether should be about 1:20 to 20:1, more preferably about 1:10 to 10:1 and most preferably about 1:5 to 5:1.

5. Buffer/pH Adjusting Agent

An additional important ingredient is ammonia, or, in its form in aqueous solution, ammonium hydroxide, $NH_4OH$. This adjusts the pH to alkaline, which is more effective for cleaning. Preferably, the pH is alkaline, more preferably, between 7 and 14, more preferably, between 8 and 13. Other pH adjusting agents, such as NaOH, LiOH, KOH (i.e., the alkali metal salts of hydroxides) and the like may be useful.

6. Miscellaneous Adjuncts

Small amounts of adjuncts can be added for improving aesthetic or functional qualities of the invention. Also, those materials below are optional and not to be considered to overlap with the already mentioned Actives in 1, above. Aesthetic adjuncts include fragrances, such as those available from Givaudan-Rohre, International Flavors and Fragrances, Firmenich, Norda, Bush Boake and Allen, Quest and others, and dyes and colorants which can be solubilized or suspended in the formulation. A wide variety of dyes or colorants can be used to impart an aesthetically and commercially pleasing appearance. Also, advantageously, the fragrance oils do not require a dispersant since the oil phase will act to disperse limited solubility oils. The amounts of these aesthetic adjuncts should be in the range of 0–1%, more preferably 0–0.1%. In terms of functional adjuncts, firstly, because the surfactants in liquid systems are sometimes subject to attack from microorganisms, it may be advantageous to add a mildewstat or bacteristat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A. G. See also, Lewis et al., U.S. Pat. Nos. 4,252,694 and U.S. Pat. No. 4,105,431, incorporated herein by reference. Other desirable solids may include salts (such as NaCl, $Na_2SO_4$), builders, electrolytes, chelating agents (without limitation, such as alkali metal salts of EDTA, preferably tetrapotassium EDTA; See Robbins et al., U.S. Pat. No. 5,972,876, incorporated herein by reference; or tetraammonium EDTA; see Mills et al., U.S. Pat. Nos. 5,814,591 and 6,004,916, incorporated herein by reference) salts, pigments, and the like. These solids, however, should be present in extremely discrete amounts so as not to affect the streaking/filming character of the inventive formulation. Additional surfactants (anionic, nonionic, cationic, amphoteric, zwitterionic and mixtures), hydrotropes, and other dispersing aids may also be added in discrete amounts, taking into account their individual performance attributes and whether their addition may affect the formulations. Foam control agents (i.e., Foam Ban MS 575) may be useful for inclusion herein.

In the following Experimental section, examples of the inventive composition are provided.

EXPERIMENTAL

In the following section, examples of various embodiments of the invention are depicted. Where ingredients are repeated in some of the Examples, and have been previously identified in footnotes in prior Examples, those footnotes are not repeated.

Example I is one preferred formulation herein.

EXAMPLE I

| Ingredient | Percent Active |
|---|---|
| Glucopon 600[1] | 0.0225 |
| Dowfax 2A1 | 0.09 |
| Ninol L-9[2] | 0.0675 |
| Dowanol PNP | 1 |
| Ethanol | 2 |
| Acrysol 644[3] | 0.061 |
| Foam Ban MS 575 | 0.005 |
| Fragrance | 0.025 |
| $NH_4OH$ | 0.00274 |
| Water | q.s. to 100% |

[1]Alkylpolyglycoside Surfactant
[2]Diethanol Fatty Amide Surfactant
[3]Polyacrylate polymer Example II is a further preferred embodiment of the inventive formulation:

EXAMPLE II

| Ingredient | Percent Active |
|---|---|
| Alfonic 1012-5 | 0.0225 |
| Dowfax 2A1 | 0.09 |
| Dowanol PNP | 1 |
| Isopropanol | 2 |
| Rhoplex 1531 | 0.09 |
| Fragrance | 0.025 |
| $NH_4OH$ | 0.00235 |
| Water | q.s. to 100% |

In the next example, the advantageous effect of the diphenyloxide disulfonate on phase, or physical stability, is explored.

EXAMPLE III

Physical Stability

The formulation of Example II is repeated, but a control without the diphenyloxide disulfonate is used as a control. It is believed that the diphenyloxide disulfonate stabilizes especially the fragrance, which is an oil, and produces a stable microemulsion, resulting in a clear, isotropic appearance. The invention and the Control are stressed under differing temperatures:

| Example | Stability @ 70° F. | Stability @ 35° F. | Stability @ 100° F. |
|---|---|---|---|
| II | Stable (at lest 5 mos.) | Stable (at lest 5 mos.) | Stable (at lest 5 mos.) |

-continued

| Example | Stability @ 70° F. | Stability @ 35° F. | Stability @ 100° F. |
|---|---|---|---|
| Control (no Dowfax) | Stable | Stable | Unstable in less than 1 week |

In the next Example, a discrete amount (1 ml) of the formulation of Example II was pipetetted onto clean black tiles, allowed to dry and then graded by 10 experienced panelists on a 1 to 10 score (1 most clear, 10 least clear). This was compared against a formulation lacking diphenyloxide disulfonate.

EXAMPLE IV

| Example | Appearance Score |
|---|---|
| II | 1.9 ± 0.9 |
| Control (no Dowfax) | 5.3 ± 1.3 |

In the next Example, a discrete amount (1 ml) of the formulation of Example II was pipetetted onto clean black tiles, allowed to dry and then graded by 10 experienced panelists on a 1 to 10 score (1 most clear, 10 least clear). This was compared against a formulation in which the diphenyloxide disulfonate was replaced with sodium lauryl sulfate, which is a typical anionic cleaning surfactant. The diphenyloxide disulfonate demonstrated superior clarity and appearance, indicating lack of residue.

EXAMPLE V

| Example | Appearance Score |
|---|---|
| II | 1.9 ± 0.9 |
| Control (SLS) | 4.8 ± 1.5 |

The foregoing experimental results are useful to illustrate the invention. However, it is not intended to limit the scope of embodiments of the invention. The claims which follow hereto further are emblematic of the invention.

The invention claimed is:

1. An improved, reduced streaking/filming dilute cleaning formulation used in a no-rinse cleaning application, wherein said formulation comprises:

a. a mixture of cleaning effective amount of surfactants, said mixture comprising at least one anionic surfactant comprising a $C_{6-20}$ alkylphenyl oxide disulfonate and at least one nonionic surfactant, said nonionic surfactant having an HLB of least about 8;

b. a water soluble polymer having a molecular weight of about 10,000 to about 50,000 Daltons, said polymer being present in a shining, restorative or anti-filming effective amount;

c. at least one organic solvent with a vapor pressure of at least 0.001 mmHg at 250° C. and soluble to the extent of at least 1 g/100 ml $H_2O$, preferably limited to no more than about 50% of said formulation;

d. at least one volatile buffer/chelating agent, in a cleaning-effective amount; and e. the remainder, water.

2. The formulation of claim 1 wherein said nonionic surfactant is selected from the group consisting of linear and branched alkoxylated alcohols and alkoxylated alkylphenols.

3. The formulation of claim 2 wherein alkoxylated alcohols are selected from the group consisting of ethoxylated, propoxylated and ethoxylated/propoxylated $C_{6-20}$ alcohols, with about 1–5 moles of ethylene oxide, or about 1–5 moles of propylene oxide, or 1–5 and 1–5 moles of ethylene oxide and propylene oxide, respectively, per mole of alcohol.

4. The formulation of either claim 1 wherein the ratio of said anionic to nonionic surfactants is about 1:0.1 to about 1:1.

5. The formulation of claim 1 wherein said water soluble polymer is a polyacrylate polymer.

6. The formulation of claim 1 further comprising (f) at least one aesthetic or functional adjunct.

7. The formulation of claim 1 wherein said organic solvent is selected from the group consisting of: $C_{1-6}$ alkanol, $C_{3-24}$ alkylene glycol ether, and mixtures thereof.

8. The formulation of claim 1 wherein said organic solvent consists of both an alkanol and a glycol ether, wherein the ratio of alkanol to glycol ether is about 1:5 to about 5:1.

9. The formulation of claim 7 wherein the total amount of organic solvent is about 1–5% by weight of the cleaning formulation.

10. An improved, reduced streaking/filming dilute cleaning formulation used in a no-rinse cleaning application, wherein said formulation consisting essentially of:

a. a mixture of cleaning effective amount of surfactants, said mixture comprising at least one anionic surfactant, said anionic surfactant comprising a $C_{6-20}$ alkyldiphenyloxide disulfonate and at least one nonionic surfactant, said nonionic surfactant having an HLB of least about 8;

b. a water soluble polymer having a molecular weight below about 2,000,000 Daltons, said polymer being present in a shining, restorative or anti-filming effective amount;

c. at least one organic solvent with a vapor pressure of at least 0.001 mmHg at 250° C. and soluble to the extent of at least 1 g/100 ml $H_2O$, limited to no more than about 50% of said formulation;

d. at least one volatile buffer/chelating agent, in a cleaning-effective amount; and e. the remainder, water.

* * * * *